United States Patent [19]

Rademacher

[11] Patent Number: 4,905,813

[45] Date of Patent: Mar. 6, 1990

[54] ESCROW CREDIT CONTROLLERS AND METHOD OF OPERATION THEREOF

[75] Inventor: Darrell Rademacher, Dryden, N.Y.

[73] Assignee: XCP, Incorporated, Dryden, N.Y.

[21] Appl. No.: 234,918

[22] Filed: Aug. 22, 1988

Related U.S. Application Data

[63] Continuation of Ser. No. 878,625, Jun. 26, 1986, abandoned.

[51] Int. Cl.[4] ..... G07F 17/00

[52] U.S. Cl. ..... 194/217; 194/206; 194/350; 364/478

[58] Field of Search ..... 194/215, 216, 217, 350, 194/205, 206, 207; 377/8, 16, 30; 235/380, 381, 382; 364/464, 478, 479; 355/14 R, 14 C, 14 CU

[56] References Cited

U.S. PATENT DOCUMENTS

| | | | |
|---|---|---|---|
| 3,815,717 | 6/1974 | Arseneau . | |
| 3,841,456 | 10/1974 | Levasseur . | |
| 4,008,792 | 2/1977 | Levasseur . | |
| 4,347,925 | 9/1982 | Sugimoto . | |
| 4,359,147 | 11/1982 | Levasseur . | |
| 4,381,835 | 5/1983 | Shah . | |
| 4,429,778 | 2/1984 | Levasseur . | |
| 4,458,142 | 7/1984 | Bernstein | 235/381 |
| 4,498,570 | 2/1985 | King et al. . | |
| 4,499,985 | 2/1985 | Schuller . | |
| 4,526,263 | 7/1985 | Levasseur . | |
| 4,541,519 | 9/1985 | Belviso et al. . | |

*Primary Examiner*—Kevin P. Shaver
*Assistant Examiner*—Edward S. Ammeen
*Attorney, Agent, or Firm*—Ralph R. Barnard

[57] ABSTRACT

An escrow credit controller for use with vending machines having a vend path which is several articles in length, such as a copier machine. The controller accepts value in the form of coins or bills, and escrows the value in an escrow total. When the escrow total deposited reaches a trigger amount which is at least equal to one more than the number of articles in the vend path times the vend price, the vending machine is enabled. The controller continues to add value to the escrow total as coins or bills are deposited, and subtracts the vend price from the escrow total upon receipt of a vend signal from the machine. When the escrowed value is less than or equal to the number of articles in the vend path times the vend price, or when the "value return" is activated by the user, the machine is disabled (possibly after a delay to avoid "trapping" the article(s)). The escrow controller retains the escrow balance for an additional time delay, during which time it continues to look for signals from the machine which indicate additional articles dispensed (copies made). After a delay sufficient to clear the vend path, either the remaining escrow value is returned (if the "value return switch" was activated) or the machine waits for the escrow value to be increased above the trigger amount again.

8 Claims, 2 Drawing Sheets

ESCROW CREDIT CONTROLLERS AND METHOD OF OPERATION THEREOF

This is a continuation, of application Ser. No. 06/878,625, filed 06/26/86 now abandoned.

BACKGROUND OF THE INVENTION

The invention relates generally to the field of controllers for check-responsive operation of mechanical vending equipment. More particularly, the invention pertains to escrow controllers for vending machines such as copiers or the like having a mechanical vend path.

An "escrow controller" is a controller for vending which has the capability of accumulating (escrowing) value deposited by a customer until a given value is deposited, at which time the machine which is controlled is allowed to dispense whatever product or service is applicable.

Many prior art escrow controllers physically "escrowed" (that is, held) the coins deposited until a vend signal or coin return signal was received, then dumped the escrowed coins into the cash box or coin return slot.

Most, if not all, prior art escrow controllers were of the "escrow to vend" type. That is, the value deposited is escrowed until the vend price is deposited. Then the vending machine is enabled, and (sometimes after waiting to receive a vend signal from the machine) the coins are dumped into the coin box or changer tubes and (as appropriate) change is returned. Many escrow-to-vend controllers have been patented, such as Arseneau, U.S. Pat. No. 3,815,717 [1974]; several Levasseur patents including 3,841,456 [1974], 4,008,792 [1977], 4,359,147 [1982], and others.

This method of operation is satisfactory in situations, such as soda or candy venders, where typically a single vend is performed for each customer (i.e. one only wants a single can of soda) and the vend is essentially instantaneous (once the machine is enabled, the can is dispensed, and the vend is over).

Such controllers are less desireable in such applications as coin-operated photocopiers. Usually, a user of a copier will want to make more than one copy. He may want to add additional value during the copying process. The copying process is not instantaneous—the paper path may be several feet long from feed bin to finished copy. Thus, it becomes necessary to hold the vend enable signal on, sense when a copy is has been made by waiting for a signal from the copier, deduct the cost of a copy from the escrow amount, and (if the escrow value has been used up) turn off the vend enable.

The copy machine can provide a pulse indicating that the copy has reached a certain point in its path, but this pulse can be derived from the feed rollers ("early"), or at some point at exposure or drum contact ("mid-path"), or at the point where the copy is ejected from the machine ("late").

An earlier patent of the present inventor, Rademacher, et. al., U.S. Pat. No. 4,519,088 [3/21/85], entitled "Usage Control System", and assigned to the assignee hereof, addressed the problem of dealing with copiers having an early or mid-path copy sense (reset) pulse. Such a copier requires an additional delay before turning off the vend enable, lest the copy be "caught" in the copy path. That patent, however, was primarily concerned with a single copy coin system, or a card-operated system, where the concern was not to catch the copy in the copy path.

In an escrow control situation with machines having mid-path or late count pulses, another problem surfaces, in addition to the problem described in the early pulse problem. If the escrow amount is debited when the count pulse is received, and the vend enable is turned off when the escrow value reaches zero (or less than one vend price), then there may be one or more copies which have already been made in the copy path, for which there is no value escrowed. The user can then get one or more free copies, if the delay of the Rademacher, et. al., patent is implemented (or if the copier allows the cycle to complete despite the lack of the enable signal). Alternatively, in some machines, without the delay the later copies may be "trapped" in the copy path and jam the machine.

Escrow controllers can be prone to another problem, as well. If a bill acceptor is part of the system, a user may insert a bill, be credited with the value of the bill, then activate the coin return. The controller will return the value of the bill in coins, and thus can be used as a bill-changer. This is especially troublesome in applications such as school libraries or the like, where the change-maker on the copier can be quickly depleted so as to provide change for the soda machine.

It is thus an object of the invention to provide an escrow credit controller suitable for use with copier machines which allows a customer to enter value for multiple vends (copies).

It is a further object of the invention to provide an escrow credit controller suitable for use with copier machines which allows a customer to enter value during the copying process, regardless of the status of the escrow value or of the vending machine.

It is a further object of the invention to provide an escrow credit controller suitable for use with copier machines which allows a customer to make multiple copies, the cost of which is debited against the escrow value.

It is still another object of the invention to provide an escrow credit controller suitable for use with copier machines which will not permit a customer to receive free copies when the escrow value is depleted.

It is also an object of the invention to provide an escrow credit controller suitable for use with copier machines which can, in an alternate embodiment, prevent its use as a bill changer.

SUMMARY OF THE INVENTION

The invention presents an escrow credit controller especially suitable for use with copier machines, and particularly those copier machines having paper paths which are a multiple of copies in length. The controller is also suitable for other vending applications involving vending machines for articles in which the vend path is more than one article long, so that there may be more than one article in process when the escrowed value is exhausted. The user is required to deposit a minimum escrow value (the "trigger value") which is at least equal to the number of copies (articles) in the vend path (between the tray and the counter), plus one, times the vend price. When the trigger amount is deposited, the copier is enabled to make copies. The user may continue to enter value into the controller, or may begin to make copies, or any combination of the two. The controller debits the escrowed value whenever a signal is received from the controlled machine.

When the escrowed value is less than or equal to the number of articles in the vend path times the vend price, or when the "value return" is activated by the user, the machine is disabled (possibly after the delay of the Rademacher, et. al. patent). The escrow controller retains the escrow balance for an additional time delay, during which time it continues to look for signals from the machine which indicate additional articles dispensed (copies made). After a delay sufficient to clear the vend path, either the remaining escrow value is returned (if the "value return switch" was activated) or the machine waits for the escrow value to be increased above the trigger amount again.

In an alternative embodiment, the machine automatically returns the remaining escrow value after the second delay, rather than waiting for more value to be deposited.

In another alternative embodiment, in order to prevent use of the controller as a change maker, the controller will require at least one vend before returning the remaining escrow value.

DESCRIPTION OF THE PREFERRED EMBODIMENT

Figure 1:
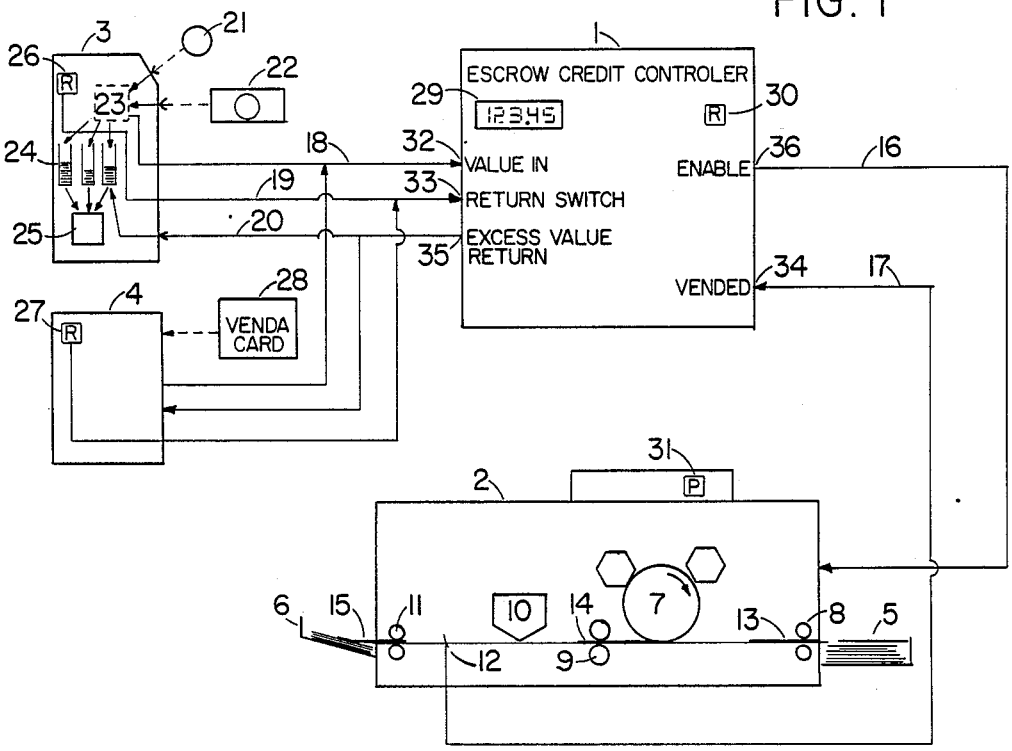
FIG. 1 shows a block diagram of an escrow credit controller system incorporating the method of the invention.

Referring to FIG. 1, the system embodying the invention is shown in block form. It will be understood that the coin box/bill acceptor (3), card reader/encoder (4) and copier (2) are shown as examples of such devices, only, and do not actually represent any particular copier, etc. In fact, the invention is not limited to copiers, but is useful with any application in which it is desired to use an escrow controller with a vending machine in which the items vended must move along a vend path which is more than one article long. Any device of the kinds described, chosen from among the many commercially available, can be used within the teachings of the invention, so long as it is capable of emitting, and responding to, the signals described in detail below.

In FIG. 1, the escrow credit controller is represented by box (1). In practical installations, this may well be incorporated into a single physical box with the coin acceptor, bill acceptor, change maker and possibly a card reader/encoder such as the Vendacard(r) marketed by the assignee of this invention.

The controller (1) will preferably have a readout (29) for communications with the customer. The readout will indicate the amount of money escrowed, and could also be programmed to produce messages such as "ERROR" or "NO CHANGE", or the like, if the displays chosen are capable of such. The controller may also have a value-return button (30), the function of which is explained below, if the controller is not integrated with the coin or card mechanism. The controller has inputs for value accepted (32), value-return (33) and item-vended (34). It has outputs for enabling the vending machine (36) and returning remaining value in escrow (35).

The actual nature of the signals received and emitted are not important, and will vary in a manner well-known to the art. For example, the "value in" signal from a coin acceptor is usually a serial train of pulses, each pulse representing a standard coin value (i.e. a nickel is one pulse, a dime is two, a quarter is five, etc.). The same signal from a VendaCard(r) reader might be a serial ASCII-encoded number, or a parallel data line of "n" bits, or perhaps a simple train of pulses similar to the coin box application. Similarly, the "value return" for a coin changer mechanism might be three lines, one each for nickels, dimes and quarters, each of which is pulsed to release a coin of the appropriate denomination, or might be a serial data stream giving a numeric coin value to be returned to a "smart" changer. For a card encoder, the same signal would be a serial data stream specifying the data to be re-encoded on the card. The "on/off" signals such as "enable", "return" and "vended" could be active low, active high, pulses of various lengths, or any combination. All of these variations could be accomodated easily within the capability of one skilled in the art.

The general operation of an escrow controller system is as follows: A customer inserts value into the system through a value accepting element, either by putting coins (21) or bills (22) in the coin/bill acceptor (23), or by inserting a magnetically-encoded card (28) such as used in the VendaCard(r) system into an appropriate reader/encoder (4). If coins (21) are deposited, they may be sorted into tubes (24) in a changer (25) for later use in making change, or just dumped into a coin box. The value accepting element generates a "value added" signal (18), which is accumulated in the controller (1) and indicated on the display (29). In prior art controllers, as soon as the value accumulated exceeded a single vend price (one copy, one can of soda, etc) the controller turned on the "enable" line (16), which allowed the vending apparatus to accept a choice from the customer. In this example, the "Print" button would become active on the copier, and the customer could then make a copy by pushing that button (31). The fact that a vend was made is indicated by the vending machine putting a signal on the "vended" line (or "copy count") (17). Upon receipt of the signal, the value of the vend is subtracted from the escrow balance. In prior art controllers, when the escrow balance declines to less than one vend price, the enable line is turned off. The controller usually then issues a "value return" signal (20) to the coin changer (25) or card encoder (4), as appropriate, if there is any change due. The coin box (3) ("coin box" usually includes the coin and/or bill acceptor, and changer mechanism), card reader/encoder (4) or controller (1) may have "coin return" switches (26), (27) and (30) respectively, which activate a "return switch" line (19). When the controller receives this signal, the enable line is turned off, and the remaining value is returned.

The copier at (2) is shown in a schematic cut-away form to allow an understanding of the problem addressed by the invention. To make a copy, the paper in the copier(2) is picked up from an input tray (5) and is conveyed by rollers (8) to the drum (7). The toner image on the drum (7) is deposited on the paper, which is pulled along by the drum and rollers (9) past heater (10) and fuser rollers (11), which fuse the toner to the paper. The paper then is ejected into the copy hopper (6). Three sheets of paper (13,14 and 15) are shown in the paper path in the drawing. Paper (13) has just been picked up, Unfused copy (14) is just leaving the drum, and finished copy (15) is leaving the machine for the hopper. In common with many copying machines, the example machine counts the copies with a switch (12) in the paper path just before the copy exits the machine. This switch generates the "vended" signal sent to the controller, and increments the internal copy counter. The placement of the switch ensures that a copy will not be counted until it actually is made, but it poses a problem which can be seen in the drawing. The paper path in the machine shown is (at least) three copies long. That is, allowing for registration of the drum, pick-up time, etc, up to three copies may be in process at any given time. In the example shown, the maximum number of copies are in the path. Copy (15) has just been counted by switch (12), and the "vended" signal has been sent to the escrow controller the phase and two copies 13 and 14 are in the vend path yet to be counted as vended. As in all external copier controllers, the value of the copy is noted upon receipt of the vended signal from the copier. In an escrow controller, the value of the copy may then be subtracted from the remaining escrow balance. Suppose, in the example, the customer had deposited (or there remained) an escrow balance sufficient to pay for a single copy (but not enough for two). When copy (15) passed switch (12) the balance would then be less than one copy in value. In prior art escrow controllers, the enable (16) line would then be disabled (either immediately, or in accordance with the present inventor's prior pate after a delay). However, there are still two copies in the copy end path (13, and 14). Depending on the design of the copier, the customer will now get two free copies (13, 14) and/or the machine will "catch" either (13) or (14) in the path and jam. Either result is "undesirable" from the copier owner's point of view. The latter situation is addressed in Rademacher, et. al., cited above. The present invention is designed to eliminate the former possibility. In the example of the copies in the vend path are copy (13) and copy (14).

Operation of the Preferred Embodiment: the Primary Loop

Figure 2B:
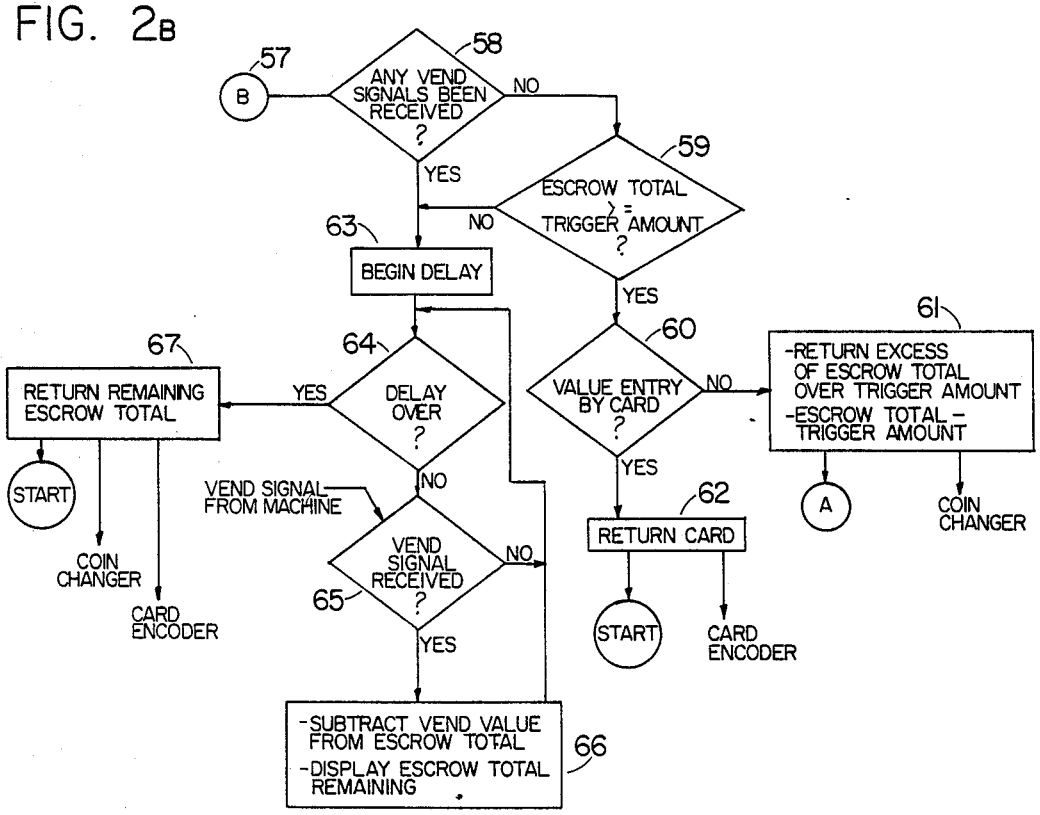
FIGS. 2*a* and 2*b* show a flowchart of the operation of the method of operation.
Figure 2A:
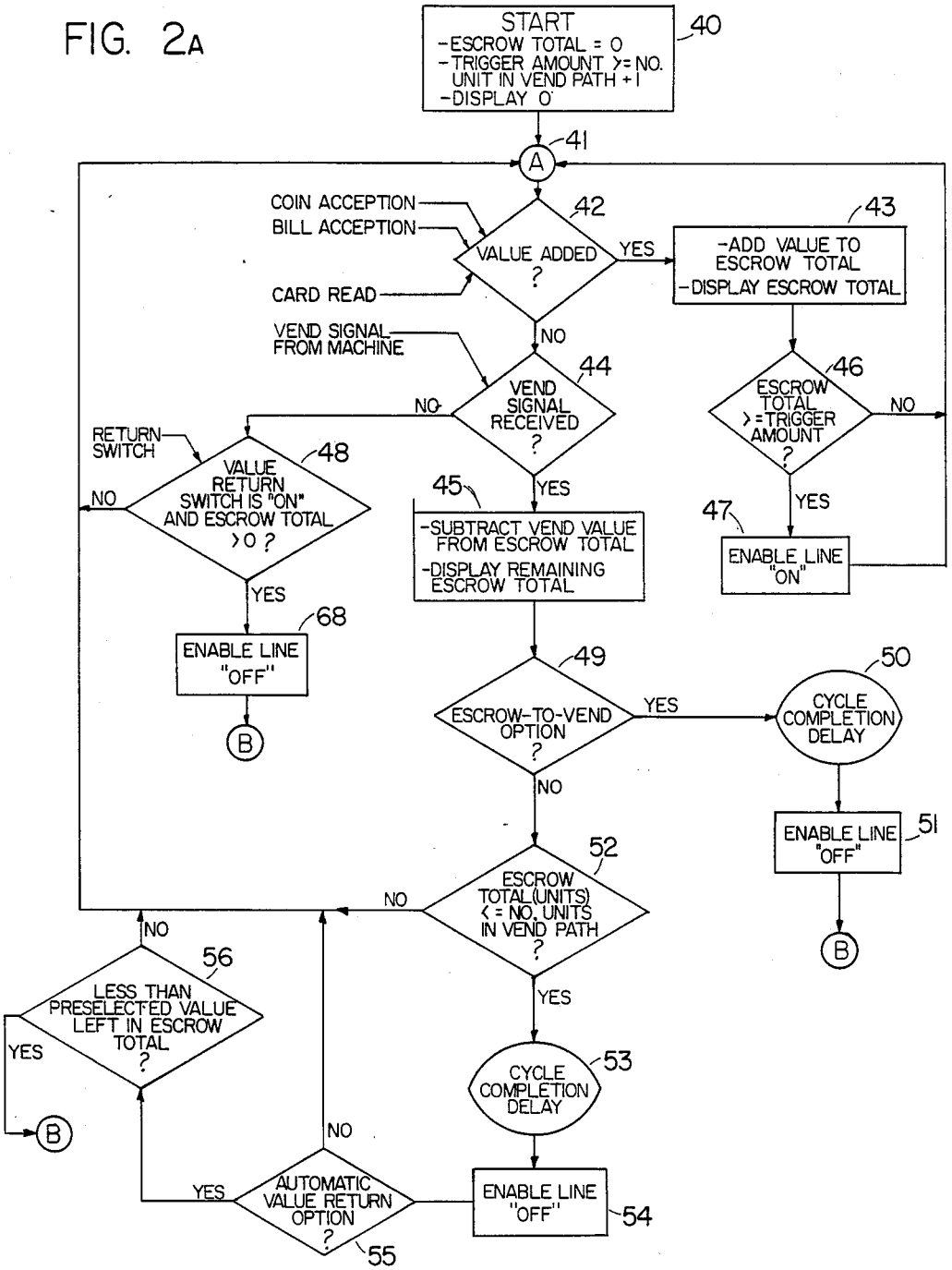

The method of operation of the invention is shown in detail in the flowcharts of FIGS. 2*a* and 2*b*. The preferred method of implementing the method of the invention is through the use of a microcomputer, programmed in read-only-memory (ROM) for the actual controller. The 68705 P-3 microcomputer, manufactured by Motorola, has been found to be suitable, although it will be understood by one skilled in the art that other microcomputer chips could be used as easily, or the invention could be constructed of discrete components, within the teachings of the invention. The method of interfacing the controller to the peripheral equipment (coin box, copier, etc.) is conventional and well-known to the art. The following description relates the operation of the invention, as shown in the flowchart, and would be the same regardless of the actual hardware used to implement it.

The controller is "initialized" (label "Start") (40) by setting the escrow total (total value deposited) to zero, and displaying a message indicating readiness to begin. (This could be as simple as a zero, or could be the word "READY", or whatever seems appropriate which the display chosen can generate). A trigger amount has been predetermined which is at least equal to one more than the number of units (copies) in the vend path (copy path). The "vend path" is defined as the value of the largest number of vend units which may be in motion through the vending machine simultaneously. The trigger amount may be chosen to be more than the value of one greater than the number of units in the vend path, if desired, but must not be less than the value of one more than the number of units in the vend path. A larger trigger amount might be chosen, for example, to discourage use of the escrow controller as a bill changer.

The main operation loop begins at label "A" (41). The controller checks the value added inputs from the connected peripherals (coin acceptor, bill acceptor, card reader) (42). If there has been any value added (43) the value is added to the accumulated escrow total, and is shown in the display. The escrow total is compared with the trigger amount (46), as defined above. If the escrow total is larger than the trigger amount (47), then the "enable" line (FIG. 1, (16)) is turned "on", which allows the vending machine (copier) to accept orders from the customer. The controller then loops back to (41) to check for more value added.

If there was no value added (44), the "vended" signal line (17) is checked to see if any units were vended (copies made) (44). If there have been copies made (45) the value of the units vended is subtracted from the escrow total, and the new total displayed.

In some applications, it may be desired to use the controller in an "escrow-to-vend" mode, in which change is returned as soon as a vend is done, instead of waiting to see if the customer wants anything else, or if he wants to deposit more money. In such a case (possibly after the delay (50) of Rademacher, et. al., the enable line is turned "off" (51), and the controller goes to the secondary loop (label "B"-FIG. 2*b*, (57)).

Normally, however, the controller will not be used in "escrow to vend" mode. Accordingly, the controller next checks the escrow balance to see if it has dropped to a value which is less than or equal to the value of the number of units in the vend path (52). Note that this value is at least one vend unit value less than the trigger amount. If it has, possibly after the cycle completion delay of Rademacher, et. al. (53), the enable line is turned "off"(54). The controller may optionally (55) be set to return change automatically when the escrow balance reaches a preselected point (say, two vend unit values). If this option is chosen, the controller checks the escrow value against this set point (56). If the escrow total is indeed below the limit (56), then the controller transfers to the secondary loop ("B" (57)).

If the automatic return option was not chosen, then the controller loops back (41) to check for value added, etc., again.

If there was no value added (42) and no vend signal (44), then the controller checks the "return" switch line to see if the customer has decided to get his remaining escrow balance back (48). If a return signal was received, the enable line is turned off (69) (possibly after the delay of Rademacher, et al (68)) and the controller proceeds to the secondary loop ("B"(57)). This ends the discussion of the primary loop.

Operation of the Preferred Embodiment: the Secondarv Loop

The secondary loop comes into play when the controller has determined that the customer is done with vending, either because he has signalled this with the return signal or because the escrow balance has run out. The purpose of the secondary loop is to introduce a delay in returning any remaining escrow balance until all potential articles in the vend path have had an opportunity to clear. FIG. 2*b* shows the secondary loop, which is entered at label "B" (57).

In order to avoid the use of the controller as a change maker, the secondary loop first checks to see if u any x units have been vended (58). If none have, and if the escrow total is greater than the trigger amount (59), and if the value was not added by card (60) then only the value in excess of the trigger amount is returned, and the controller returns to the primary loop. Thus, the customer must make at least one copy before he can get his change (less the cost of the copy). Obviously, if the value was added by card, no change is involved, and the value is simply returned (62).

If at least one copy was made, then the controller begins a timed delay (63). The delay time is set to the length of time needed for the vend path to clear. On a copier, this may be 5 to 30 seconds, depending on the copier design. During the delay period, the controller checks for additional vend signals from vend units in the vend path as they clear the machine (65). If any vend signals are received during the delay (66), the value of the vends is subtracted from the escrow total and displayed, and the delay loop continues.

After the delay time is over (64), the remaining value is returned (67), either with the coin changer or card encoder as appropriate, and the controller is re-initialized (label "START" (40)).

Accordingly, it is to be understood that the embodiments of the invention herein described are merely illustrative of the application of the principles of the invention. Reference herein to details of the illustrated embodiments are not intended to limit the scope of the claims which themselves recite those features regarded as essential to the invention.

I claim:

1. A method of operating an escrow credit controller for vending machines for providing vend units to customers and which has a vend path within the controlled vending machine capable of serially processing a plurality of vent units simultaneously, the controller being capable of accumulating total value added by a customer through one of several value-accepting peripheral devices, enables the controlled vending machine based on the value accumulated, removes value from the accumulated total based upon operation of the vending machine, and disables the vending machine, the controller having value-added input means for accepting signals from the value-accepting peripheral equipment indicative of value accepted by said peripherals, value-return switch input means for accepting a command from the customer to return the remaining value of the accumulated total value, value-return output means for commanding a value-emitting peripheral device to supply the customer with a specific amount of value, enabling output means for permitting the vending machine to perform its vending function, and vended signal input means for accepting signals from the vending machine indicating that the vending machine has supplied the customer with a vend unit, in which the improvement comprises a method of operation, comprising, in the following specified sequence: a pre-operation step, an initialization operation, a primary operating loop and a second value-return loop;

a. the pre-operation step comprising setting a trigger amount which is at least equal to one more than the number of vend units in the vend path, times the price of one vend unit;

b. the initialization operation comprising setting the accumulated total to zero;

c. the primary operating loop comprising the steps of:
   1. examining the value-added input means to determine if value has been added by a customer; if value has been added, proceeding with step c.2, if not, proceeding with step c.5;
   2. adding the value added to the accumulated total value;
   3. comparing the accumulated total to the trigger amount; if the accumulated total is at least equal to the trigger amount, then activating the enable output means;
   4. repeating step c.1;
   5. examining the vended signal input means to determine if a vend unit has been vended by the controlled vending machine; if one has been vended, proceeding with step c.6, if not, proceeding with step c.9;
   6. subtracting the value of the vended unit from the accumulated total;
   7. comparing the accumulated total with a vend path value which is equal to the number of possible units in the vend path times the value of a single vend unit; if the accumulated total is less than or equal to the vend path value, then de-activating the enable output means;
   8. repeating step c.1;
   9. examining the value-return switch input means to determine if a value-return switch has been pressed; if a value-return switch has been pressed, then de-activating the enable output means and proceeding with the secondary value-return loop; if not, then repeating step c.1;

d. the secondary value-return loop comprising the steps of:
   1. starting a delay timer;
   2. comparing the time elapsed in the delay timer with a time period which is at least sufficient for all of the possible vend units in the vend path to be processed;
   3. if the time elapsed is at least equal to the time period, then activating the value-return output means to cause the value-emitting peripheral device to supply the customer with the amount of value remaining
   4. examining the vended signal input means to determine if a vend unit has been vended by the controlled vending machine;
   5. if one vend unit has been vended, then subtracting the value of the vended unit from the accumulated total;
   6. repeating from step d.2.

2. The method of operating an escrow credit controller of claim 1, further comprising display means for displaying at least the value in the accumulated total, in which the method further comprises the step of displaying the accumulated total whenever the accumulated total is changed.

3. The method of operating an escrew credit controller of claim 1, in which the primary operation loop of the method further comprises, after step c.7, the step of comparing the accumulated total to a preselected amount, then proceeding with the secondary value-return loop.

4. The method of operating an escrew credit controller of claim 1, in which the secondary value-return loop of the method further comprises the initial steps, before starting the delay timer, of:

a. determining if any vended signals have been received since the initialization step; if any have been received, then proceeding with step d.1;

b. comparing the accumulated total to the trigger amount; if the accumulated total is not greater than the trigger amount, then proceeding with step d.1;

c. activating the value-return output means causing the value-emitting peripheral device to supply the customer with a value which is equal to the excess of the accumulated total value over the trigger amount;

d. setting the accumulated total to the trigger amount;

e. returning to the primary operation loop at step c.1.

5. The method of operating an escrow credit controller of claim 4 further comprising the step, after step 4.a, of determining if the accumulated value was added through coins and/or bills; if the value was not through coins and/or bills then proceeding to step d.1.

6. The method of operating an escrew credit controller of claim 1 in which the controlled vending machine is a photocopier, and the units are copies.

7. The method of operating an escrow credit controller of claim 1 in which the value-accepting peripherals are selected from a group consisting of coin acceptors, bill acceptors, and magnetic card readers.

8. The method of operating an escrow credit controller of claim 1 in which the value-emitting peripheral comprises one or more devices chosen from the group coin changers and magnetic card encoders.

* * * * *